United States Patent [19]

Caines

[11] 4,401,327

[45] Aug. 30, 1983

[54] NYLON TWINE AND THE LIKE HAVING AMELIORATED KNOT STRENGTH

[76] Inventor: R. Scott Caines, 108 Ashmore Rd., Greer, S.C. 29651

[21] Appl. No.: 361,525

[22] Filed: Mar. 23, 1982

Related U.S. Application Data

[63] Continuation-in-part of Ser. No. 272,779, Jun. 11, 1981, abandoned.

[51] Int. Cl.[3] ..... D04G 5/00; B05D 1/18; B05D 3/02

[52] U.S. Cl. ..... 289/1.2; 427/393.5; 427/430.1; 428/395

[58] Field of Search ..... 427/45.1, 55, 421, 389.9, 427/428, 430.1, 393.5; 428/267, 395; 57/258; 289/1.2

[56] References Cited

U.S. PATENT DOCUMENTS 2,859,135 11/1958 Rossin ..... 57/258

4,263,337 4/1981 Login ..... 428/395 X

*Primary Examiner*—Michael R. Lusignan

*Attorney, Agent, or Firm*—N. Jerome Rudy

[57] ABSTRACT

Various nylon filamentary materials, including twine, rope and other cordages, are rendered resistant to knot and other interlacement slippage by treatment with certain latex compositions that form a tightly-adhering, blockage-promoting and -assisting surface film on the treated filamentary product so as to enhance physical knot strength propensities and characteristics of the treated-twine and equivalent product insofar as particularly relates to mechanical undoing of the knot under pulling stresses (as distinct from "knot strength" breakpoint tests indicative of the tensile strength of the filamentary nylon product, per se). Styrene (i.e., "St")/butadiene (i.e., "Bu") and like and analogous synthetic resinous latices—especially those of the carboxylated variety—are particularly good for achievement of the anti-slippage in knot formation enhancement of the nylon filamentary goods involved. The treating method adapted to bring about the advantageous desiderations as well as the beneficially treated nylon filamentary product are also involved in comprehensive keeping with the invention.

30 Claims, 3 Drawing Figures

NYLON TWINE AND THE LIKE HAVING AMELIORATED KNOT STRENGTH

HISTORY OF THE APPLICATION

Figures 1, 2, 3:
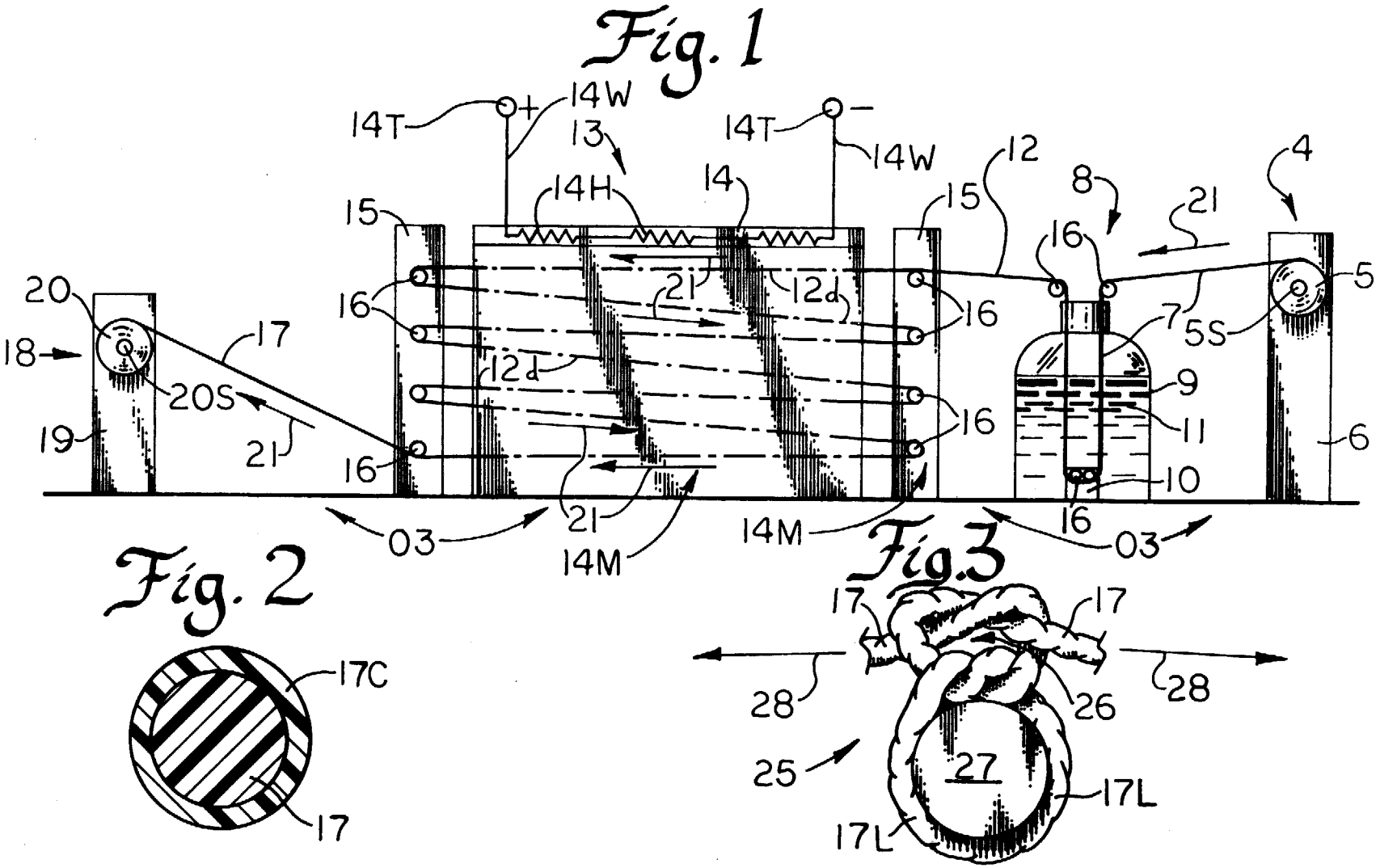

The instant Application is a Continuation-In-Part of the co-pending but herewith-abandoned Application of United States Letters Patent made by the present Inventor and entitled "IMPROVED KNOT STRENGTH IN NYLON TWINE, ROPE, YARN AND CORDAGE" having Ser. No.: 06/272,779 which was filed June 11, 1981, now abandoned.

BACKGROUND OF THE INVENTION

Amongst the various twines, yarns, cordages and the like or equivalent funicular structures (as hereinafter more fully defined), those of nylon are especially prone to have notably sleek and non-cohesive surface characteristics. Knots and other interlacements of nylon twine and the like are particularly notorious in their pronounced propensity to slip and loosen after formation and be lamentably susceptible to undependable knot-formation-holding capability and unreliable mechanical interfastening characteristics.

To emphasize this by frequently-encountered and well known comparative observations, the basic granny knot (one of the simplest and often inherently-followed cord interlacing patterns) tends to fairly satisfactorily hold well when made with a cotton twine. To the contrary, however, nylon twine of equivalent size when knotted granny-style will, virtually and literally, tend to not hold whatsoever; there seeming to be insufficient intersurface grip and relative blocking action between the contacting interlacings of the involved nylon twine to enable the knot to maintain its intertwined formation and have suitable durability and strength, especially when subjected to any pulling-apart tension.

Even knots of other synthetic resinous materials that would ostensibly seem comparable to nylon are not prone to such knot strength inferiorities and frustrating knot formation failures as those associable with knots of nylon twine and the like. This, consequentially surprising as it ultimately appears, is the case by way of particularized illustration when regarding performances of knots from such materials in twine or the like form as polyesters (including "DACRON" -(Reg. TM)- yarns) and polyolefins (including polyethylene and polypropylene) in contrast with the generally poorer results with nylon twine knottings.

At least some of the conundrum may also lie in the exaggerated inclination of nylon filamentous material to elongate and become extendingly prolonged under tension; being so stretchy, as it were, as to imbue knot formations therefrom with a lively proclivity to slip and easily loosen thereby becoming quickly untied.

Despite the glaring need involved in the problem, there is a paucity of known practical expedients for its satisfactory resolution. Nylon and other synthetic yarns and the like textile materials have been provided with vast numbers of finishes, sizes, coatings, etc., of seemingly endless variety for many diverse purposes. This includes latex applications for specific end results. In capsulated illustration of this: U.S. Pat. No.: 4,300,615 discloses the treatment of reinforcement tire cord fabric to improve its adhesion to rubber with specialized latex compositions made with copolymerized monomer constituents of distinctive amide intermediate; Canadian Pat. No.: 507,594 shows the sizing of nylon and other yarn products with specialized latices prepared from plural component copolymers of certain dicarboxylic compound salts and alkenyl aromatic monomers with contained polyglycol salt plasticizers in order to better adapt elastically-prone (especially under stress and strain) fiber lengths to endure the rigors of weaving in loom operations; and U.S. Pat. No.: 3,484,179 teaches a way to achieve selective finishing agent applications on non-uniformly fabricated yarn products (including woven goods) by utilization of dielectric heating, etc., to unevenly fix the agent which may, in some cases, be comprised of a latex composition. None of the given citations, however, offers anything in the direction of improving the strength of knots made from the involved yarn or preventing knot slippage so as to eliminate the incidence of knot failures in treated nylon or other cordage.

Thus and notwithstanding, nothing in prior art seems nor appears to realistically concern itself with the problem of avoiding knot failures made from nylon twine and the like or of precluding the inherency of nylon twine, etc., knottings to loosen, slip and fail in use and be characterizable in possessing typically dissatisfactory knot strengths nor lead to an effective, efficient and extremely reliable means and technique—with advantageous resulting products thereof—for simply and readily adapting nylon twine and the like to be formed into strong, reliable and dependable knots by any implementation as in the way so crucially indigenous as is in the present contribution to the art.

FIELD AND PURVIEW OF THE INVENTION

The present invention, and the principle aims and objectives attainable in its practice, pertain(s) and direct(s) to a novel and, in the overall, unprecedented and exceptionally efficient means and techniques for readily and efficaciously rendering nylon twine and the like or equivalent line and cordage resistant to slippage and physically-loosening disruption when tied into knots so as to enable such funicular product(s) to be made into strong, safe and secure knots and the like interlacements upon the physical joining and intertwining of ends or lengths one-portion-with-another of such cordage without necessitating any reliance for the purpose on various mechanical clamping and/or buckling, etc., contraption accessories (such, as one demonstration of those, as is the clincher found set forth in U.S. Pat. No.: 3,644,966); as well as to the nylon twine and the like goods beneficially so treated and enhanced plus the strong and unique non-slip and securely inter-clutched knot products and formations so advantageously obtainable therewith.

The achievement and provision of all indicated, with even more and additionally other benefits and advantages derivable in and from practice of the invention appear(s) and become(s) more evident in the ensuing description and Specification.

MATERIALS AND MAKINGS FOR AND OF THE INVENTION

As a clarifier of what can be done and used to get the possibilitated results in practice of the present invention, the following expanded and somewhat particularizing discriptory of involments utilizable therein and resultant therefrom is included.

(A). The Nylon(s)

The materials of which the involved twine and the like products to be improved to achieve better, tougher and stronger knottability therewith in following this invention are composed either are generally fiber-forming superpolymeric amides of protein-like structure (which also have been termed silon-⟨s⟩- and furon-⟨s⟩-) first provided by Dr. Wallace H. Carothers in association with E. I. DuPONT de NEMOURS & CO., Inc. and/or fiber-forming lactam polymers credited to Dr. Paul Schlack (of I. G. FARBEN Industries in Germany) as reported by R. Bauer at Page 114 in Das Jahrhundert der Chemiefasern (Munich, Goldmann Verlag, 1958) one form of which is the commercially-known "PERLON" (Reg. TM) which is also often referred to as nylon-6-polymer.

Typical superpolyamides of the type emulating the work of Carothers are from aliphatic dicarboxylic acids, such as adipic acid or sebacic acid, and aliphatic diamines, such as hexamethylenediamine. They have the representative structure:

$$\{-\underset{\underset{O}{\|}}{C}(CH_2)_4-\underset{\underset{O}{\|}}{C}-NH-(CH_2)_6NH-\}_n. \qquad (N)$$

"PERLON" and other nylon-6 materials are obtained by the polymerization of ε-caprolactam. Nylon-7, etc., analogous to nylon-6, is/are gotten by polymerization of higher corresponding lactam starting materials.

(B). The Twine And The Like

Twines and the like of nylon(s) are available in many sizes which range in given dimensionalities from those of typical threads to ropes and the like physically-bulky cordage constructions. Ordinarily, multifilament fabrications are involved in the twine goods utilized in practice of the present invention. These include, on a somewhat rough scale-designation according to increasing physical (especially at-least-nominal diameter) sizings or grades: threads; strings; yarns; lines; cords; ropes; and so forth insofar as relates to various lines and (literally) "endless" lengthwise provisions of strandular cordage product. In some amplification of this, typical rope structures available include those that are so-called plain-laid as well those known as being shroud-laid (the latter comprising assemblies in which there are contained four strands and -⟨and about⟩-a heart or core) and/or cable-laid (these, for example, containing three plain ropes which are laid together with a left-hand twist).

While it is not impossible nor without expectable merit to utilize monofilamentary nylon products in practice of the invention, multiple-filament arrangements of the nylon twine to be improved in high-strength and slip-free knot-providability characteristics and properties are most frequently encountered. Multifilament products are generally of an at least twisted and very often braided type; although untwisted or relatively low-twist structures may also be employed; with, per the foregoing indication, complex rope structures of plural, prefabricated cordages all not uncommon for usage. The individual configuration (both cross-sectionally and sometimes lenthwise) of the separate filaments involved is also widely variable. The thread or twine employed is, very often, produced from continuous filament supplies although many suitable cordages are possible to employ which have been produced in staple-length spinning operations for providing the involved yarn(s). The filaments (whether used in continuous length or staple forms) may be round and uniform in cross-section or otherwise so-configured (i.e., uniformly cross-sectioned) shapes including those that are curvilinear in section, such as ovals, as well as those having polygonal outlines including square and rectangular shapes or those that are substantially so. On the other hand and regardless of characterizing cross-sectional features, the involved filaments from the longitudinal perspective may also have thick-and-thin sections at regular or irregular spaced intervals along their lengths and/or may be converted into constructional yarn supplies for fabrication into twines and the like which yarns have analogous "slubs" or more bulkily-diametered portions along their lengths. Furthermore as is more-or-less the case with continuous circularly-cross-sectional filaments (or staple lengths), the filamentary strands incorporated into the twines and the like for use in the present invention may be flagelliform in nature; or they may be anguilliform in shape; and so on and so forth. Sometimes there is a noticeable tendency for twines made with irregular filament configurations in the strands from which they are made to actually show somewhat better tying performance due to the better-gripping interaction of the constructional fibers therein involved; all this to some extent and sometimes coming about by the mechanical interlocking influence and co-relative physical hindrances arising from affect of the irregular filamentary shapes in the involved twines and the like. Even "fuzzy" or pubescent yarns can help in this way.

Nonetheless and for convenience, all of the foregoing possibilities of cordage fabrications, rope constructions, etc. are herein and hereafter predominantly referred to as "twine(s)". In this, the most commonly-encountered nylon twine product to be benefitted by or which is the actual treated product result of practice of the present invention are those commonly seen and used multiple filament "tying" twines or strings ordinarily gotten for household, office and analogous applications; with industrial use (such as for shoe strings, baling twines, etc.) also had of it.

No special pre-treatment or conditioning of the nylon twine to be treated pursuant hereto is necessary in most instances; the latex application productive of beneficiating the funicular goods having markedly ameliorated and drastically improved strong and slip-resistant knot formation characteristics being decidedly preferable to be done on and with uncontaminated, raw or "naked" twine. Nonetheless, care should be taken that the twine starting material to be advantageously treated is at least substantially essentially (if not absolutely completely) free from any attached debris, dirt, wax, grease and the like or similar objectionable contaminants. In any such event, ordinary cleaning of the raw twine as a preliminary and most prudent precaution should, for optimization of results, be observed and undertaken. Optimumly conditioned twine is this way had.

(C). The Latices Employed For Twine Treatment

Unexpectable as it may ostensibly and cursorily be, the latex preparations that are so advantageously employed for treating of the nylon twine to secure the very desirable knot-strength- and -durability-beneficiating capability thereof are commonly available (at least to a very significant extent) materials of commerse. They are aqueous dispersions, invariably in emulsion or solution distribution, or carboxylated diene-monomer polymerizates. As a large-volume, merchant-commodity illustration of such there may be mentioned the carboxylated St/Bu lataxes industrially available from THE DOW CHEMICAL COMPANY that find great and widely-extended use in and for carpet backsizing applications amongst other utilities therefor. Corresponding and more-or-less analogous and similar carboxylated diene-monomer polymerizates in latex dispersion preparations, as more fully brought forth immediately hereinafter, also find good adaptability for usage in practice of the present invention.

In any event (whether or not admixtures, as is possible, of given suitable latices are employed for the application), the particular latex formulation or preparation utilized should have the easy and ready capability of thoroughly wetting the surface of the involved nylon twine so as to, with and upon whatever drying and/or other fixing manipulations after application may be necessary, enable formation of a tightly-bonded, essentially-integral and strongly-adhering circumenveloping and relatively or comparatively thin coating or layer of the resinous latex constituent on and about the twine surface which forms a non-slick, unslippery, blocking-promotional and clutchingly skid-resistant superstrate for the twine which imbues same with its then-achieved, unnatural good and satisfactory features of permanently strong and durable interlacing knottability features and potential. It also materially reduces cut and timing in multifilament twine. Considered in another light, the latex applied must be capable of materially and most contrastively (as compared to its normal condition in such regard) increasing the coefficient of friction effectual in rubbing and binding contacts of the treated nylon twine surface.

Retrospectively recognizable, the carboxylated diene monomer interpolymerizate latices so propitiously emloyed in the practice of the instant invention have the innate capacity to more thoroughly and efficaciously wet surfaces, such as those on nylon twine, having high surface energy tension tendencies. This phenomenon of such latex preparations at least conjecturally imparts to them their exceptional aptitude for utilization to achieve present aims and purposes. To illustrate this with true hard applicable data on the point, the surface energy tension of $H_2O$ (i.e., quite pure water) is 72 dyne centimeters. That of nylon, literally invariably, is exactly or closely about 46 dyne centimeters. On the other hand, that of a typical polyester is only on the order of 43 dyne centimeters while conventional polyethylene has a very much lower surface energy tension value of only 31 dyne centimeters. The involved differences, while numerically value-wise seeming not too distant one-from-another, are pragmatically of significantly-meaningful moment.

Such wetting efficacy is not common to all latex preparations with respect to nylon surfaces and exceeds very largely what is requisite for suitable wetting potential of many other surfaces, including those upon shaped articles of most other synthetic resinous polymer compositions. Additionally, as has been explained, the physical characteristics of most other synthetic resinous substrate materials are not such that, when fabricated into twines and the like, they demonstrate such severe propensity to knot-slippage and formation-instability on interlacing as such infirmities are so abundantly rife in knot constructions from untreated nylon twine(s).

Another important characteristic for present purposes of the caboxylated diene-monomer interpolymerizate latex materials used in practice of the present invention is their capability, which is collatable to the magnified coefficient of friction they impart as superstrate formations to the therewith-treated nylon twine(s) on which they are imposed, to be effective in retention of bindability-promoting and anti-slip engendering intrinsic "tackiness" which, even after complete drying, is at least (mechanically-speaking) measurably discernible if not, as it sometimes may be, perceptible to the hand or touch. In other words, the applied latex compositions are aptly-possessed of the physical tackiness inherencies that are so beneficially promotive of achieving the desired "strong-knot" results with tied-together nylon twine(s) as occurs when following practical reductions of instant conceptions.

The diene-monomer polymerizates (which, in actuality, may be copolymeric and/or interpolymeric—including grafted structure—molecular arrangements) can be derived from a wide variety of conjugated diolefin substances which, characteristically, are usually capable of being polymerized into sulfur-vulcanizable elastomeric resinous products. These even include natural rubber (otherwise known as Hevea Brasiliensis which generally consists of polyisoprene, also correctly nameable as poly-2-methylbutadiene) despite the fact that carboxylation of natural rubber almost inescapably requires utilization of graft copolymerization procedures. In any event, the diene monomers that are converted into the latex preparations useful in practice of the invention are of the general Formula:

$$H_2N{=}\overset{\overset{\displaystyle X}{|}}{C}{-}CH{=}CH_2, \qquad (I)$$

wherein X is selected from the Group consisting of hydrogen, chlorine and methyl radicals.

Bu, especially butadiene-1,3, is especially well suited for utilization as a Formula (I) monomer. Another besides isoprene that is a very useful Formula (I) monomer to employ for manufacture of the latices to be involved in 2,3-dimethylbutadiene-1,3, as well as mixtures of various of such diene monomers.

While carboxylated diene-monomer polymerizates are susceptible of good use in the latex formulations employed for practice of the present invention, it is usually more advantageous for the polymerizate of the diene monomer of the Formula (I) which is involved to be formed into a copolymerized structure, independent of the carboxylating ingredient, with another interpolymerizable monoethylenically-unsaturated monomeric material which, with considerable preferability thereabout, is an alkenyl aromatic monomer of the Formula:

$$CH_2{=}\overset{\overset{\displaystyle G}{|}}{C}{-}Ar, \qquad (II)$$

wherein G is selected from the Group consisting of hydrogen and methyl and Ar is an aromatic radical (including various alkyl- and halo-ring-substituted aromatic units) of from 6 to about 10 carbon atoms. Commonly, it is most preferable to utilize St as the alkenyl aromatic monomer of the Formula (II) for the indicated copolymerization purpose with the Formula (I) diene monomer(s). Nonetheless, other alkenyl aromatics are also frequently quite satisfactory; these including α-methylstyrene(s), vinyl toluene, vinyl naphthalene, the dimethyl styrenes, t-butyl styrene, the several chlorostyrenes (such as the mono- and dichloro-variants), the bromostyrenes (also such as the mono- and dibromo-variants), isopropenyl toluene, and so forth.

In selecting a carboxylated diene-monomer interpolymerizate latex for use in practice of the present invention, attention must be given to the degree or extent of tackiness or block-promoting "stickiness" or adhesional adhesiveness that is wanted or which is best suited for any desired given result relevant to knot-strength potential(s) of the involved treated twine(s). This, of course, bears some correlation to the anticipated loading level or deposited coating or layer weight and thickness that is to be applied in treating the twine. As is readily appreciable, considerably less of a more tacky latex may provide corresponding increases in coefficient of friction magnification in and on the treated twine than more of a less tacky formulation. In this, the general rule that pertains is that proportionally higher interpolymerized Formula (I) monomer contents in the latex formulation tend to give correspondingly greater degrees of inherent tackiness in the final latex product to be employed. Of course, some latices in given heavier or lighter applications may be more tacky than desirable or attractive for handling and use and others may be not enough so; something readily determinable upon routine investigation by the skilled worker for any latex product under consideration (taking into account, as indicated, conditions of application along with adhesion power or blocking capability wanted or needed in the treated twine).

Another ancillary consideration in making the latex selection for use in practice of the invention is the anticipated or likely-to-be-encountered end use to be made of the treated twine. Water-sensitivity of the applied latex superstrate may, for example, be an undersirable factor if the product will find probability of use with actual exposure to water and/or under conditions of relatively high humidity. Prolonged exposure to ultraviolet light may cause a discoloration problem, as in tending to give the treated twine a pronounced yellowish (or even other-colored) hue. As would be expectable, differing compositions of the latex preparations possible to employ have varying water-sensitivity characteristics and/or diverse capabilities for withstanding discoloration upon exposure to ultraviolet light. Storage and/or usage in heat at relatively higher temperatures is yet something else with which to reckon; with differing latex formulations tending to have changing influencing-responses to possible deleterious consequences of thermal effects insofar as concerns heat-tolerability. Again, the skilled worker will undergo no real difficulty in making appropriate determinations to guide latex choice for use to make treated twine(s) having various expectations of encountering possibly-damaging storage and/or utilization conditions; with ageing a factor therein.

Regardless, when an alkenyl aromatic monomomer of the Formula (II) is combined in the latex interpolymerizate, there should generally be at least about 0.5–1.0 percent by weight based on total weight of interpolymerizate involved (i.e., "wt.%") of the interpolymerized Formula (I) diene monomer in the composition. More often, there is advantageously between about 25 and about 60 wt.%, oftentimes even more beneficially from about 35 to about 50 wt.%, of the Formula (I) diene monomer interpolymerized with Formula (II) alkenyl aromatic copolymers to provide the latex polymer; with, of course, an appropriate and satisfactory quantity of the carboxylating component also contained in the product polymerizate.

If desired (and sometimes with attending resulting benefit for particular end-use requirements), varying usually minor proportions of other ethylenically-unsaturated, addition-polymerizable monomers may, as has been indicated, be included in the interpolymerizate carboxylated latex preparations in copolymerized formations with only the Formula (I) diene monomers or in mixtures of the Formula (I) monomers with Formula (II) alkenyl aromatic components, this being the case when Bu alone or St/Bu mixtures are so utilized. These include such monomers as: acrylonitrile (or vinyl cyanide as it is sometimes known); α-methacrylonitrile; methacrylamide; several of the vinylpyridines (including 2-vinylpyridine and 2-methyl-5-vinylpyridine); methyl vinyl- and/or methyl-isopropenyl ketones; vinyl halides, particularly vinyl chloride; various vinyl organic acid esters, such as vinyl acetate and vinyl propionate; maleic anhydride; and so forth.

The carboxylating component interpolymerized with the Formula (I) or Formula (I)/Formula (II) monomer(s) or monomeric mixtures or mixtures of yet other monomers with those of Formula (I) or those that are Formula (I)/Formula (II) monomeric mixtures in and for the preparation of the latices to be employed in present practice are of the Formula:

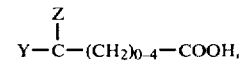

$$Y-\overset{\overset{\displaystyle Z}{|}}{C}-(CH_2)_{0-4}-COOH, \quad \text{(III)}$$

wherein: Z is selected from the Group consisting of hydrogen, alkyl radicals that contain not more than about 4 carbon atoms and carboxyl units when Y is devoid of any carboxylating attachments and Y is a monoethylenically-unsaturated substituent selected from the Group consisting of methylene, alkene and alkenyl units containing from 2 to about 5 carbon atoms (including vinyl, isopropenyl and other alkyl-substituted arrangements) and, when Z is not carboxyl, carboxylated methylene and mono-carboxylated alkenyl units containing from 2 to about 5 carbon atoms.

Predominantly includable and quite useful as Formula (III) carboxylating intermediates are the acrylic acids, such as acrylic acid per se and methacrylic acid as well as certain of the monoethylenically-unsaturated, dibasic carboxylic acids such as fumaric and/or maleic acid(s) (i.e., "MA"). Others worth mention are itaconic acid, isocrotonic acid and so forth.

As a rule, there should be at least about 0.5 wt.% of the carboxylating constituent provided by interpolymerization of a Formula (III) monomer (or mixture of such monomers) contained in the polymerizate constituting the latex preparation employed for the nylon twine treatment in practice of the invention. Along this line, amounts of this in excess of about 10 wt.% are usually not of particular advantage; although it is possible to synthesize carboxylated St/Bu and the like polymers with included contents of an interpolymerized Formula (III) monomer as large as 20–25 wt. % of same therein incorporated. Such highly carboxylated interpolymers are, in fact however, worked with only for quite highly specialized needs and applications. In this connection and as a general rule sort of behavior of carboxylated resinous materials, the water-sensitivity of the product increases relatively proportionally to content of carboxylating constituents and tends to become rather considerable and predominating at greater than 10 wt. % or so inclusion levels. Thus, as with many things, a balance must be struck in selecting the carboxylated interpolymerizate of the Formula (I) diene monomers, etc., for use as the latex preparation with which to treat the nylon twine(s) in practice of the present invention with respect to desirable and necessary adhesion power necessary to therein have as against unduly problematic water-sensitivity which, if overly excessive, may be causative of other undesirable characteristics in the final product obtained. Thus, the approximate 1-5 wt. % range is often used. Once again, anyone skilled in the art finds no difficulty for given purposes and needs to select and employ a suitable and satisfactory carboxylated latex material to use.

As a quite specific illustration of composition of carboxylated latex that finds very wide and acceptable applicability in practice of the invention, one constituted with about 59 wt. % St/40 wt. % Bu/1 wt. % MA provides fine demonstration as a material that is very nicely adapted to achieve instant purposes.

As is well known, the dispersed polymer solids content of latexes, in general, can be as great as 60-70 percent by weight taken on total weight of latex preparation (i.e., "% by wt."). Usually for most economical bulk handling and transport purposes, the water content of the latex is kept as low as possible consistent with suspension or emulsion maintenance in the involved product. So, it is quite common for latexes as obtained from commercial sources (and depending on the nature of the particular latex involved) to have polymer solids contents minimums of 25-30 % by wt. and, more typically, at least about 50 % by wt.

It is possible to employ such concentrated latex products directly for many end-use operations therewith; the same even being applicable to practice of the present invention. However, it is oftentimes necessary to exercise great care in utilization of such polymerizate-rich latices in order to preclude difficulties which may arise on account of the very high solids content thereof; this being especially relevant to practice of the present invention.

Thus, when coating and the like manipulations are involved (as in the instant situation), too high a solids content in the latex employed may tend to result in excessively heavy and more generous than practically or otherwise necessary for adequate coating or layering applications obtained with the more commonly-utilized application techniques. Of course, there may be nothing about which to be concerned as relates to possible overcoating depositions if resort is had to specialized applicating technuiqes that, normally, are not customary and usually rely for success on ultra-high speed operations or use of the latex in highly-particularized fashions (as deposition from atomized-atmosphere conditions as in fogs or mists, etc.), and so forth and so on.

Nonetheless and especially for present purposes, it is advantageous and facilitated-of-execution to utilize the latex preparation of twine treatment in a solids concentration range that is between about 0.5 and about 10% by wt., more often in this regard in the 1-5% by wt. range. Again, this depends in any given situation upon the particular application technique to be involved wherein such things as time and temperature factors, depositing efficieny for particular coatings with given twines, desired loading extents, etc., must be considered; with good results under any given set of conditions and desiderations obviously within the ken for achievement of the ordinary artisan.

As is expectable, the latex preparations employed may also (and normally do) contain other conventional materials and residues from manufacture; these often including non-aqueous volatiles, non-polymer solids, stabilizers of various sorts and for various purposes and other intentionally-incorporated functional additives.

Certain of the acid-containing carboxylated latex preparations useful for employment in practice of the present invention may, after application to the nylon twine(s), require specialized curing procedures and/or actions to thereupon be undertaken for their proper and most effective setting displacement as the applied superstrate on the twine. In all realism and practicality, however, this is of no great or difficult to manage import or consequence and incurs no particular detraction from the general simplicities involvvolved in and the many benefits and advantages to be obtained by and from practice of the present invention, as is all readily apparent in this connection to anyone skilled in the art.

(D). Application Of The Latex

Any variety of a great number of available techniques and coating procedures may be invoked and put into function for coating or layer-providing superstrate deposition formation of the carboxylated latex preparation on and over the external surface of the nylon twine(s) being, essentially, externally treated in practice of the present invention. Many of these are common in textile sizing. Usually and probably most conveniently if not most expeditiously, dip or submersion applications are made by passage of the raw twine undergoing treatment through a bath or like or equivalent volumetric supply of the latex utilized in the twine-conditioning treatment. Regardless of particular coating technique employed, the procedure followed should be one that facilitates production of the nylon twine product so that the same is evenly-coated and provided with a relatively thin film that is mostly, if not entirely, a skip-free surface layering skin of the applied latex polymerizate material residue which is functional in achieving the ameliorated knot-strength capabilities of the nylon twine in keeping with the invention. Good surface drenching with the latex is needed for this.

Along this line, particularly when dip-applicating techniques are invoked for the treatment, the solids content of the involved latex preparation is oftentimes found to be dissatisfactorily ineffective when dilute to an extent materially less than about 0.5 % by wt. and, conversely, needlessly and undesirably wasteful and inefficient of available latex supply and usage when concentrated to any significant extent above about 5 % by wt; all this to be taken into the comprehensive account that, notwithstanding, both lesser and greater concentrations in the ratio of polymer solids to total latex weight are operable possibilities for the formulation of the latex preparation used for the twine treatment.

When dip application is done, it is usually advisable to drain off or use mechanical wiping means (such as chasers, etc.) to remove excess latex from the treated yarn prior to drying. This, of course, is pursuant to conventional procedures employed in such operations. Most frequently in dip-application procedures, a continuous length or a plurality of such as in assembled arrays of the twine to be treated is continuously passed in submersion through a bath or equivalent contained volume of the latex medium, after which it is therefrom removed for drying and subsequent handling. However, it is also feasible to accomplish dip applications by immersion of the twine to be treated in a latex supply bath according to batch procedures or those in which, instead of running filamentary lengths, wound or otherwise assembled supplies of the raw nylon twine to be treated are batch-wise or via moving-passage subjected to the latex medium to be applied. Thus, the dipping may be accomplished on skeins, hanks, loops or the like or equivalent collections of the raw twine or even with loosely wound supply packages thereof put up in sleazily and non-tightly-formed cone, bobbin or similar supply provisions, such as a yarn "cake", wherein the loosely-filled package is amenable to thorough liquid permeation and penetration in order to have efficient contact with all of the wound strandular material therein.

So-called "kiss"-wheel methods of latex application are also frequently suitable for the twine-treating procedure. These entail, as is well known, rotating wheels, cylinders, drums or the like whose outer circumference is wet with the latex supply in a quantity sufficient to be fed off the surface of the wheel and transferred therefrom to any contiguous object, such as a length of twine, that is in contact with the wet surface (preferably in wrapped-around relationship) so as to adequately provide a satisfactory application to the material passing over the wheel to thoroughly coat and finish the surface of the material with good application of the liquid agent.

Spraying, painting and/or brushing (and so forth) of the raw twine to be treated with the latex preparation to be applied is oftentimes also a suitable and convenient technique for getting the latex onto the twine in satisfactorily-deposited superstrate layer form. Along this line and has been indicated, the twine may also be treated by passing it through a chamber or enclosure, for example, wherein the latex is present in misted, atomized or other "fog" dispersed solids-in-air distribution wherefrom it tends to satisfactorily deposit as a coating deposition on the twine (much in the manner employed for vacuum or other metallization of films, etc.). Electrostatic assistance following known ways for the purpose may also be utilized in atomized latex applicating procedures.

Notwithstanding how applied and as has been indicated, the coating or layer of the carboxylated latex preparation should be in a relatively thin, literally imperceptible and pragmatically arcane film or superstrate layer formation on and about the twine. As to the quantitative aspects of this, the weight of the applied coating with respect to the gross weight of the latex-treated twine is generally in almost insignificant, miniscule proportions. Invariably, for entirely satisfactory results to be had, it is much less than any quantity of applied coating that even approaches such a deposit or loading level of as great as 1 % by wt. of the treated twine product. Sometimes with specialized coatings, however, even more can be employed. Pertinent to this is the undesirable possibility that too heavy and thick of an applied coating may give unwanted rise to very deleterious and intolerable tendencies towards stripping and peeling delamination or skinning off of the applied latex superstrate in handling and/or use of the treated twine. Actually, the loading of the applied latex coating on the treated twine is ordinarily of such low mini-(and/or even micro-)-unit %'s by wt. fractionations as to require laboratory style analytical gravimetrical determinations to find precisely what is the applied latex solids level in most given situations. As a rule, nothing even approximately near 1% by wt. is ordinarily used for constitution of the applied superstrate latex solids layer.

(E). Drying of the Freshly-Wet Treated Twine

There is nothing critical or extraordinarily-required as relates to operational and accomplishment procedures undertaken in and for the drying of the freshly-treated nylon twine. And, relevant to this and per what is anticipatable from what has been already elucidated concerning applied coating loading levels, satisfactory drying of the applied carboxylated latex preparation can usually be accomplished in ready and straightforward manner without any special unit operation exercise(s) needing to be brought into play. This is for the reason that the applied latex layer is ordinarily put on and present in proportion(s) that, insofar as concerns measurability thereof, more or less approach(es) "vanishing point" sorts of physical presence and actual deposit-loading extent(s). Thus, not too much liquid, relatively speaking, is required to be removed from the applied latex preparation, layer in order to obtain a satisfactorily- and practically-dried result from the (wet) treated twine.

All that need be accomplished in the drying is to remove all, or at least substantially all, of the water and other possible volatiles from the applied latex so that the treated yarn is no longer wet and presents a "dry" feel or touch upon handling (this, of course, relating to actual wetness to the hand or touch above and beyond whatever physically-perspective "tacky" feel that the product treated twine may have).

Drying in air of freshly-wet treated twine at normal room or other ambient temperature is oftentimes quite suitable for the water, etc.-removal purpose to provide a satisfactorily-dried treated twine product.

In high-speed, volume production situations, however, it can oftentimes be more expedient to employ heating ovens or the like chambers or enclosures in order to more speedily and efficiently dry the treated twine. These may, as desired, be electrically-heated or fired otherwise from any suitable fuel source. Often, standard sorts of convection ovens may be nicely employed for the purpose; even though radiant heating, dielectric or microwave heating means and the like or equivalent can also be advantageously employed.

The freshly-wet treated yarn, as best may suit any given manufacturing operation, may be dried before final packaging by passing continuous lengths of it through the drying means or by subjecting other assemblies thereof (such as skeins, hanks, loosely-wound packages, etc.) to the heat-drying effect.

One obvious precaution to observe, needles to mention, is that, no matter how it is dried, the treated yarn should not be subjected to heat at any such elevated temperature (even if very rapid or what might be characterized as "flash"-drying techniques are involved) as might cause any decomposition or degradation of the applied carboxylated latex superstrate and/or the nylon twine substrate, per se.

And, additional to what is above mentioned, the treated yarn may even if desired be dried after collection in finally-packed wound or otherwise-disposed form; although this is generally not the recommended or most desirable way to do drying because of other problems (mostly inter-twine-strand sticking) that it may lead to.

(F). Other Equippage

As is fundamentally the case with the mechanical installations employed for the latex application and twine drying procedures done in practice of the present invention, the operating units and machinery employed throughout manufacturing embodimentations of the invention are generally of the type to be found and employed in conventional textile producing and handling facilities.

For example, the raw nylon twine to be treated may be advantageously furnished out of bobbins, cones or other equivalent wound supply package sources as delivered to the dip or alternate latex-applying unit from and by means of a standard creel or creeling operation, especially in instances when the twine is to be handled and process in continuous running lengths. Of course, any other suitable supply means may be employed to accommodate raw twine furnishment for treatment; this depending in large part on what is actually involved in the treating procedure and in what form and style of provision the raw twine is gotten and contained in supply.

Likewise, the finished and drawn treated twine may be taken up for packaging (for subsequent shipment and/or use) according as may be desired to conventional techniques; again depending to large extent on what sort of finished packaging or output containment is desired or in order and how the twine is physically manipulated through the treatment thereof pursuant to the invention. When continuous running lengths are treated to provide the product, standard winding take-up machinery is quite advantageously utilizable. This includes those, of course, that are adapted to put up the treated twine product into such packagings as spools, cones, bobbins, core-centered assemblies and so forth such as wrappings about flat-strip supports or on boards and even in coreless windings, etc.

Direct in-plant product use may naturally eliminate need for package.

(G). The Knots

The treated twine product of the present invention may be tied into any desired form or style of knot or interlaced arrangement for whatever holding, wrapping or other purpose may be needed with the twine. As is fundamental, the knots are usually made with the free ends of a given length of twine or to connect a length of twine to another line of the same or different strandular material or to fasten it upon or about some other object. While the treated twine is usually tied together with the same or another piece of the same treated or untreated twine product, it is possible and not unusual—as has been indicated—for a length of the treated twine to be interlaced in a knot formation with and for connection to a length of a given strandular material not made of nylon including those of various natural and synthetic textile fibers, metal strands and so forth.

In any event, the knots made with the treated twine of the invention are, as they are hereinbefore amply characterized, of strong formation and resistant to slipping and unwinding consequences even when subject to pulling stresses and strains tending to undo them. They have extraordinarily good bight and grasp thereabout.

A granny knot, as noted, is amongst the most commonly-employed and utilized of simple connecting interlacements for twine and the like tying that are encountered. Part of the reason for this is that most people inherently tend by natural inclination of normal hand movement to form a granny knot when interconnecting by interlacement two loose ends of twine to be joined for any reason. But for most things and unless it is thought about or inherited from nautical or other experience, a surprisingly high percentage of individuals when faced with a twine-tying requirement will preferentially make the simple knot construction in the fashion of the granny formation instead of going to a generally less slippage-prone "square" knot pattern of intertwinement or even some other style of knotting.

Yet, despite the probability that the granny knot is classically representative of the quintessence of undependable and readily unloosenable knottings exhibiting only modicums of resistance to slipping apart and breaking when subjected to pulling stress even granny knots made with treated nylon twine in accordance with the invention have the indicated remarkable improvement thereabout in general knot strength and quality with surprising security therein.

Of course, other knot constructions and formations can, as needed and/or wanted, be made with the presently involved treated nylon twine; uniformly demonstrating in this superior results and performance with any given knot-tying pattern as compared to the same knot made with equivalent size raw nylon twine identical in all respects but for latex superstrate to the treatment twine of the invention which artifically imbues great increase in knotting power.

Besides granny and square knots, other knot types that can be advantageously made with the presently-involved treated twine product include, by way of illustration: anchor knots (or the fisherman's bend); becket or sheet bends; Blackwall hitches, both single and double; bowknots, both single and double; bowlines or bowline knots; bowlines either running, on a bight or with a bight; builder's knots or clove hitches; carrick bends, single or double; cat's paws; clinches, both inside and outside; cuckold's necks; diamond knots; double hitches and double hitch adaptations of Blackwall double hitches; the Englishman's tie knots; figure-of-eight knots (which are popular to prevent unreeving); the fisherman's bend knot for hawser to anchor fastenings; flat knots; Flemish knots; French shroud knots; German knots (which are actually figure-of-eight species); half hitches, both one and two; harness hitches; the hawser bend which is a sheet bend; hawser fastening knots; the heaving line bend of clove hitch; lanyard knots; loop knots; magnus hitches; manrope knots; marlinspike hitches; marling hitches; Matthew Walker knots, both single and double; the mesh knot form of sheet bend; midshipman's hitches; the netting knot form of sheet bend; the open hand knot which is a loop knot with a loop cut; overhand knots; prolonge knots; reeving-line bends; rolling hitches; rope-yarn knots; round seizing; round turn and half hitch formations; running bowlines; running knots which are slipknots; sheepshank constructions; sheet bends and double sheet bends; shroud knots; the single knot which is an overhand knot; slide knots; slipknots; the reef knot which is another name for the square knot; stevedore's knots; stopper knots; studding-sail halyard bends and studding-sail tack bends; the stunner hitch which is a form of double Blackwall hitch; surgeon's knots; throat seizing formations; timber hitches; timber hitch and a half hitch constructions; wall knots that are single, crowned, double with single crown and double with double crown; the weaver's hitch form of sheet bend; and so forth.

In this connection, the basic principles and limitations of: nylon materials of construction; twine(s) and the like cordages and their fabrication and use; latexes and the manufacturing and handling thereof, including polymerization procedures in suspension and emulsion; coating and superstrate layer formation application and the various means and procedures therefor necessary, including associated apparatus as for dip coating, etc.; drying techniques and means and facilities for implementation of same; textile handling and packaging machinery and techniques; knots and knot-tying; machine and machine parts design and implementation(s) for the presently-contemplated purposes; suitable materials of construction for given utilization requirement; and so forth are so widely comprehended by those skilled in the art that greatly elaborated detailing and/or fundamentals-explanation of all the basics thereof and/or above and beyond the limited explanations and indications here put forth is not herein made or attempted; the same being unnecessary for thorough understanding and recognition of the advance possibilitated for achievement and realization by and with the present treated twine development and its outstanding improvement possibilities and realizations that are according to and in keeping with the present contribution to the art.

SUMMARY OF THE INVENTION

The present invention, in its genesis and as derives from the discovery on which it is based, concerns, inter alia, the indicated novel means and technique for vastly improving and markedly beneficiating the capability and potential of nylon twine and the like or equivalent cordages to be formable into and possibilitate the making of knot constructions and the like interlacings made with and provided from such twine which knots in their strength, durability and secure dependability features are surprisingly characterizable as being slip-free (to an at least substantial if not complete extent) and resistant to slithering and loosening unwinding and breakage upon subjection to pulling stress and strain; the involved procedure comprising: taking or providing a supply of raw nylon twine or the like; applying a thin and adherent superstrate coating deposit layer on and about the surface of the twine of a carboxylated diene-monomer interpolymerizate latex preparation in aqueous dispersion for the application; then drying the applied latex dose to leave a bight-providing thin film envelopment of the resinous interpolymerizate of which the said latex is constituted on and about the treated twine surface. Packaging take-up of the treated nylon twine or the like product normally follows the above-capsulated procedure.

Treated nylon twine and the like product as well as the strong and dependably-secure knot formations and constructions made from such treated twine are also here envisaged and intended as integral parts of the invention.

By and large, the various suitable materials, means, sub- and overall procedures plus other implementing facilities and apparatus and machinery for utilization, as well as working details and usage indications, embodimental instructions and other specifics of the invention have already been brought forth in the foregoing Specification; the same being additionally supplemented by the further delineations which follow.

In this and as appears from what heretofore has been disclosed as well as from the additional revelations that follow, still other features and implementations of beneficial import and salience above and beyond the simplified basics immediately-above stated are advantageously combinable in and made integral part(s) of the principal and above-fundamentally-described beneficial way of treating nylon to ameliorate its knot-providing capabilities along with the thus-resulting treated twine product and knot assemblies therewith.

ILLUSTRATED EXEMPLIFICATION OF THE INVENTION

The invention is pictorially demonstrated in and by the three (3) views of the accompanying Drawing which, for simplicity and convenience, are illustrated in mostly schematic and/or fanciful manners of representation including, also for purposes of enhanced clarification, purposefully exaggerated portrayals insofar as concerns involved dimensionalities, etc. but in all of which to the greatest possible extent there is utilized the same reference numeral designations for like and/or similar parts and elements wherein, as they are to be taken in conjunction with the Specification that follows:

FIG. 1, in side elevational view sort of portrayal, is a fanciful and relatively schematic representation of an installation adapted to treat and process raw nylon twine and/or the like and equivalent funicular materials in order to obtain the greatly-beneficiated treated twine product of the invention;

FIG. 2 is a cross-sectional and intentionally exaggerated view of a treated nylon twine or the like cordage product showing the applied, intrinsically mechanically tacky, bight-providing and friction-increasing enveloping superstrate deposit layer or thin coating film of tightly-adhering, applied and dried interpolymerizate residue of the carboxylated diene-monomer polymerizate-containing latex preparation employed in practice of the present invention; and FIG. 3 is a partly broken-away front elevation view of a strong and dependably secure, slip-free and loosening-resistant granny knot construction from the treated nylon twine product of the invention in tied disposition about an object to be contained by fixed encirclement of the twine and all in accordance with the hereinvolved invention.

For expedience and enhanced recognitive ease in the comprehension of: associated parts, units and components and materials; sub-procedures and overall procedures; certain companion movements, functions and so forth; and resulting products and knot assemblies; reference thereto is now had to all such predominant cooperative componential features and consequences and product of their operation as they appear within the accompanying FIGURES included in the Drawing with an explanation thereof in the following catalogued descriptory of same as they are identified by their respective reference numeral designations — i.e., "Ref. No(s)"— and, in which, when a given Ref. No. is intended to convey a general designation with an arrow-headed lead line associated therewith to point out a so-referenced item as it is thus illustrated in any of the views of the Drawing in which said Ref. No. occurs, that Ref. No. is accompanied by an asterisk (*) in the below-presented explanatory listing.

| Ref. No(s). | Description With Relevant Corollary Explanation |
|---|---|
| 03* | Twine treating process installation. |
| 4* | A creel or other station for supply of the raw nylon twine to be treated. |
| 5 | A supply package, such as a loaded spool or bobbin, of the raw nylon twine to undergo latex applicating treatment. |
| 5S | The mounting spindle for supply package 5. |
| 6 | The stand or other mounting fixture or framework for the creel or equivalent raw nylon twine supply station. |
| 7 | The strand of raw nylon twine being withdrawn from the creel supply for treatment. Note that no drive or actuating means are indicated or in any way shown in the Drawing. |
| 8* | The latex dip station for coating application. |
| 9 | A vessel or other container for the bath of liquid latex employed for the dip-applicating operation. |
| 10 | A submerged guide support for the raw twine being treated as it passes through the latex bath. |
| 11 | The liquid latex bath supply for the dipping operation. |
| 12 | The wet and ready-for-drying treated nylon twine in its passage and after withdrawal from the bath to be dried. |
| 13* | The drier unit apparatus facility comprising the drying station through which the continuous length of the treated wet nylon twine intermediate is passed for finishing. |
| 14 | A radiant heater unit assembly component of the drier unit. partitions |
| 4M | The enclosing/and associated twine handling stand(s) construction associated with the drier apparatus. |
| 14H | The resistance heater elements in heater unit 14. |
| 14T | The electrical terminals for the current going to the resistance heaters 14H which, when DC electricity is used (as it can be although this is a mere matter of choice since AC current-powered heaters are equally suitable) have a positive (+) contact and a negative (−) contact. |
| 14W | The electrical conduit(s) between the terminals and heater elements. |
| 15 | Support stands in or associated with the drier unit on which and in the construction wherein they are mounted are the guide means for directing and passing the treated twine through and for drying in the drier apparatus. |
| 16 | Rollers (or pulleys or guide bars or the like or equivalent twine guiding and handling appurtenances) about which the twine from raw to treated and finished stages of processing is passed and physically directed and manipulated through the treating procedure. |
| 17 | Dried treated nylon twine as it is coming from drying station 13 for passage into a packaging or other take-up means. This dried twine is the "slip-proof", latex-caoted product of the invention. |
| 18* | The product take-up station for packaging thereof. |
| 19 | The support stand in the take-up station 18. |
| 20 | A package, such as a wound bobbin, cone, etc., of the dried treated nylon twine ready for shipment, before or after storage, and subsequent use. |
| 20S | The spindle or other driven bearing means for the take-up package being formed of the treated twine product. |
| 21 | Directional arrows (FIG. 1 only) illustrating the path of movement of the twine throughout the treating procedure. |
| 17C | Shown only in FIG. 2, the applied latex twine coating layer. |
| 25* | An object of literally any sort tied and secured with a length of circumenneloping and constraining treated nylon twine product pursuant to the invention, which twine has had its lose ends interlaced and formed into a granny knot assembly formation for end-to-end interconnection of the twine. |
| 26 | The granny knot, per se, as an article of manufacture that is according to the invention which has been made and tied from treated nylon twine product made by a latex-treatment procedure both of which are in keeping with the invention. |
| 27 | The object itself that is tied by the granny knot-joined twine as is all brought forth in the showing of FIG. 3 of the Drawing. |
| 28 | Directional arrows in FIG. 3 demonstrating the stress pulling of the free ends of the twine which tends to help knot construction when both ends are pulled but, when only unilateral pulling strain is applied on one of the loose ends out of the knot, (Like other physical knot manimulations and strainings), engenders knot disruption, loosening and breaking when there is insufficient surface friction and to clutch on/the twine and insufficient bight and integrity-maintaining grasping and resistance to unraveling in the knot. |

With an overview of the foregoing disclosure and instructional parameters and revelations being maintained, the subsequent portion of this Specification now turns to specifically illustrated embodimentations and applications of practice of the present invention.

WORKING EXEMPLIFICATION OF THE INVENTION

The following demonstrations still further illustrate the invention.

First Illustration

Approximately twenty (20) inches (i.e., ca. 50.8 centimeters) of ordinary raw nylon twine or string was taken as a test sample. The nylon twine involved was commercially available from WELLINGTON PURITAN MILLS, Inc. of Madison, Ga. 30650, having been a Size No. 18 product with Catalogue No. 10482.

The sample length was completely immersed in a 5% by wt. (dispersed polymer solids content) of a St/Bu/MA carboxylated latex obtained from THE DOW CHEMICAL COMPANY of Midland, Michigan 48640 under a modified version using MA instead of fumaric acid of the trade-designation "DOW Latex 892". This latex product has been widely utilized as a carpet backsizing finish.

After thorough soaking, the sample was removed from the latex bath and allowed to dry in air at room temperature for about an hour. At that time, it was completely dry to the touch with no substantial difference in its hand as measured against that of the raw twine.

Various types of knots were then tied in smaller length pieces taken from the treated sample of twine. These included square and granny knots. All of the knots made were then carefully tested for slippage propensities therein under unravelling stress tension manually applied.

Amazing as it was to behold, the problem of knot slippage and breakage due to coming undone by enloosenment was totally eliminated in the knot constructions made with the treated nylon twine. This effect, incredible as it seemed, was most noticeable and spectacularly evident with the inherently-prone-to-slippage granny knot samples that were made and tested.

In contrast, granny knot samples made with the as-obtained, raw and untreated No. 18 string were easily and almost effortlessly pulled apart upon testing; this having been in literal complete contradistinction from the indicated fact that the granny knots of the treated twine could not be so broken.

Second Illustration

Two additional samples of the same No. 18 nylon twine as was utilized in the First Illustration were taken from the supply package in which they were contained.

One of the samples was treated with the same modified "DOW Latex 892" then dried in the same way as done for said First Illustration. The other was left untreated.

Both samples were then immersed in tap water at room temperature for 91½ hours. They were then removed from the water immersion and, while still in the undried condition and "wet", as it were (taking into account the hydrophobic nature of nylon), immediately separately tied into individual granny knot constructions.

The several knots tied in the "wet" treated nylon material held tight and well to practically the same extent as the same knot tied from dry treated twine described in the First Illustration. Close scrutiny of the "wet" treated-twine granny knot suggested possibility of almost immeasurable inferiority in its strength and loosenability as compared to the knot from dry treated twine. Notwithstanding, after drying in the tied condition, the water-exposed granny knots of the treated twine had the same excellent knot strength and durability characteristics as those made of treated twine not exposed to water wetting.

The granny knots tied from the untreated twine made while the string was still "wet" from its water immersion showed slightly better performance (but at the still dissatisfactory level) than the same knots tied in the as-obtained and unwetted twine. Yet, after the "wet" untreated twine samples were allowed to dry, they showed the same instability and undesirable propensity to be very easily pulled loose and broken as granny knots from the as-obtained and non-water-subjected raw nylon twine.

Third Illustration

A small-scale assembly was made for treating nylon twine in continuously-running lengths thereof. This included a simple, one-package creel stand and a small vessel (having somewhat less than a one-liter capacity) for containing a latex dip bath. There was also provided for the assembly a wooden frame piece having thread mounting and holding posts or projections thereon upon and between which wet latex-treated twine could be laced in a plurality of almost horizontal back-and-forth passes across the framework. The thereupon-strung twine was thus nicely exposed for drying by means of a 1,200 watt electric resistance room heater capable of heat radiation (and of the commercially-available sort of such appliance) when placed closely-adjacent to the latex-wet twine-filled drying rack; the heater also having been included in the assembly along with the other components thereof for cooperation in the twine treatment.

The capacity of the dryer frame rack unit was such that it could handle at least 75 meters (i.e., more than 250 feet) of twine threaded thereon in wrappings about the framework.

The dip vessel was provided with a submersible ring guide sort of accessory through which to thread twine within the dip bath during its running passage therethrough. The guide means was of galvanized steel construction.

A manually-turnable bobbin holder (spindle-mounted in a stand therefor with a hand crank for operation) was also provided in the assembly. A bobbin was included with this for drawing off the twine supply from the creel to pull raw twine through the latex bath in the pattern of passage made when utilizing the guide ring in bath-submersed position. Alternatively and as was done in some runs, the twine could have been manually uncreeled into passage through the bath for hand winding on the dryer rack. In either case, the bobbin winder was utilized for taking up the dried treated twine product from the dryer rack into a rewound package of same. When the latex-wet twine was drawn through the dip bath via the bobbin winder, it was manually laced for drying on the drier framework after having been pulled as intermediate undried treated twine from the temporary bobbin put-up storage therefor.

The above-described mini-assembly was very much akin to the processing-facility arrangement depicted in FIG. 1 of the Drawing.

In one of the runs made with the assembly, an 83-meter ⋖i.e., 272(+)-foot⋗ capacity supply package of the No. 18 nylon tying twine in raw condition was installed in the creel; this being the same starting material as was utilized in both of the above-given First and Second Illustrations hereof. About a quart (i.e., ca. 0.945 liter) of the same modified "DOW Latex 892" diluted with water so as to have a 5% by wt. polymer solids dispersion concentration for the dipping treatment was charged into the dip bath vessel container. The raw twine, after initially having been threaded through the subsequently-immersed ring guide means, was slowly withdrawn by hand from its supply in the creeler so as to pass, at room temperature, through the carboxylated latex treating bath. As it was being manually pulled out of the bath, the freshly-latex-wet intermediate treated twine was simultaneously manually wrapped on the drier rack unit until all 83 meters of the treated material were (with continuous removal therefrom) thereon temporarily stored for drying. The drying was done with assistance of heat from the radiant heater which, for the purpose, had been placed in such disposition that good thermoemission was directed upon the wet thread wound up in the drier. After having reached a satisfactorily-dry condition, the treated yarn product from the dryer rack was wound into an identical winding pattern as was in the raw twine supply package to furnish, with and upon the bobbin winder, a bobbin-supported package of the final product.

Very good and high-strength knots were then tied from the treated twine taken out of the bobbin supply. These included some granny knot specimens.

The bobbin of treated yarn was then stored for two (2) years in a drawer under typical household conditions. When granny knots were made, as was done, of the 2-year old treated twine, they had the same quality, appearance and nice-holding strength and durability of that in the first-made granny knot specimens.

This, of course, demonstrated that the durability of and effectiveness in old treated nylon twine that is in accordance with the present invention is, insofar as concerns any deleterious effect incurred by ageing phenomenon, commensurate with the ageing durability and character of and essentially controlled and limited only by that of the applied latex coating and the nylon twine itself.

Fourth Illustration

Several experiments were conducted to observe dip pick-up capabilities and efficiencies of various-strength (as relating to solids dispersion concentration) latices for treatment of nylon twine pursuant to the invention.

A series of dip bath formulations were prepared at differing dispersed solids levels from the same modified "DOW Latex 892". These, upon dilution with water of the commercially-available carboxylated latex stock, were made to respectively contain solids dispersed at: 2.5; 1.0; 0.5; and 0.25 strength levels all on the % by wt. basis.

Several twenty (20)-inch = ca. ½-meter = lengths of the same No. 18 wrapping twine utilized in the first three Illustrations were then (in plural test lots) individually immersed until thoroughly superficially wettened in each of the latex dip formulations that has been made up. After that, each separately marked and identified sample specimen was air-dried at room temperature for about an hour. Thereafter, granny knots were tied up in and with each of the treated nylon twine specimens that had been so obtained.

For comparative purposes, the same thing was done with additional twine samples dipped in a 5% by wt. preparation of the same "DOW Latex 892" stock.

There was no significantly perceptive difference in the knot strength and quality of the specimens treated with either the 5% by wt. or 2.5% by wt. latex dip baths.

There was a very slight—albeit practically of no consequence or material moment (on any realistic basis of comparison)—empirically discernible or at least within the shadow of rigid suspectibility decrease in the knot slippage tendencies observed in the granny formations tied with treated yarn from the 1.0, 0.5 and 0.25% dip baths. Notwithstanding, there was still remarkably-good knot-strength characteristics about the granny knots tied from the twine specimens that had received the latex treatment from application of the lowest-strength, 0.25% dip bath. Despite this, it appeared that more satisfactory and better results without the necessity of unduly long dip immersions or other extraordinary applicating steps being undertaken could more assuredly and confidently be had from the simplest sort of treating procedure if the solids dispersion strength of the latex dip bath were maintained at at least about the 0.5% by wt. concentration level.

The foregoing procedure was again repeated excepting to utilize for the dip bath a 50% by wt. solids dispersion concentration of the same modified "DOW Latex 892". The treated nylon twine showed just about the same very good knot-providing capability as that found in the specimens made from the 5.0% by wt. latex dip bath; any slightly superiority in the tied specimens treated with the more concentrated latex formulation that was barely visually discernible or at least strongly imaginable upon manual knot-strength testing hardly justifying the excessive amount of polymer used in the very highly-concentrated latex dip. It thus was impressive that a dip bath made up with no more than 5% by wt. dispersed solids latex stock or within some reasonable (say, ±10%) deviation from that level would be quite satisfactory for most simplified and easy-to-manage twine treatment procedures and constitute a fair upper limit of solids concentration for the latex dip bath in many operations conductable in accordance with the present invention. Of course, higher-speed passages and corresponding minimized-time exposures of the raw twine through latex baths, etc. as concerns other possible latex applicating media, of greater dispersed solids concentrations will generally provide the desired good results without involving unwanted and possibly wasteful utilization of the treatment-providing latex preparation employed.

Analogously-excellent and superior desirable results are obtained when the foregoing is repeated excepting to employ other raw nylon twines, ropes or other cordages for treatment utilizing other varied latex preparations (including those without any polymerized St or other monoethylenically-unsaturated monomer therein) for the twine-treating purpose and when other knot constructions other than the granny-style are made of the treated nylon twine and/or the like or equivalent treated cordage products of the invention.

Many changes and modifications can readily be made in and adapted to treatment procedure, treated nylon twine product and knot article of manufacture assembly embodiments and practice in accordance with the present invention without substantial departation therein from its apparent and intended spirit and scope, all in pursuance and keeping with same as it is set forth and delineated in the hereto-appended Claims.

What is claimed is:

1. Method for markedly ameliorating the capability and artificially-provided potential of nylon twine and the like funicular cordage strandulations to be reliably tied into strong, durable and slip-resisting knot formations that are characterizable in having features of secure dependability with at least substantially, if not completely, eliminated propensities to slitheringly loosen and become mechanically broken and separatingly de-interlaced upon subjection to pulling-apart stress and/or strain force, which method comprises the steps of:

(a). taking a furnished supply of the raw nylon twine;

(b). making as a superficial and thoroughly-surface-drenching dosage upon and over the complete external portion of the raw nylon twine supply (a) a thorough application covering of a carboxylated diene-monomer interpolymerizate latex preparation in aqueous dispersion; then (c). drying the applied latex in situ on the nylon twine surface to thereupon form a tightly-adhering, circumenveloping thin film superstrate skin deposit of polymer solids from said latex adapted to impart a greatly-magnified coefficient of friction to the surface of said nylon twine whereby it assumes extraordinary bight and grasping blockage-binding power when interlaced into inter-treated-surface physical mutual contact, as when placed in a given form of knot construction.

2. A method in accordance with the method of claim 1 and including, in addition thereto and further combination therewith, the extra Step of:

(d). taking-up into a supply package therefor the dried, treated nylon twine product from said drying Step (c).

3. The method of claim 1, wherein said latex-application Step (b) is conducted by subjecting said raw nylon twine supply (a) to immersion in a dip bath supply of the carboxylated latex.

4. The method of claim 1, wherein said raw nylon twine supply of Step (a) is furnished in continuous length form and the respective application of latex to the raw twine and subsequent drying to form finished treated twine product of said Steps (b) and (c) are performed in continuously-moving manner of procedural operation as concerns the method handling and processing of the twine being treated.

5. The method of claim 1, wherein said latex-application Step (b) is conducted with a carboxylated latex preparation having a dispersed polymer solids content therein in the range of between about ½ and about 5 weight percent, based on total weight of the involved latex preparation (i.e., "% by wt.") for drenching application to the raw nylon twine being treated.

6. The method of claim 3, wherein said latex-application Step (b) conducted by means of dip-bath immersion of the raw nylon twine being treated is done with a carboxylated latex preparation in and for the bath having a dispersed polymer solids content therein in the range of between about ½ and about 5% by wt. for drenching application to the raw nylon twine being treated.

7. A method in accordance with any one of the methods of claims 1-6, inclusive, wherein the carboxylated diene-monomer latex applied in said Step (b) is an interpolymerizate in aqueous dispersion of at least about 0.5 percent by weight, based on total weight of the involved polymerizate (i.e., "wt. %"), of interpolymerizate resinous material that has been converted from a diene monomer of the Formula:

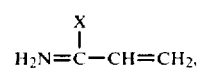

$$H_2N{=}\overset{\overset{\displaystyle X}{|}}{C}{-}CH{=}CH_2, \qquad (I)$$

wherein X is selected from the Group consisting of hydrogen, chlorine and methyl radicals; with any balance containing an interpolymerized carboxylating component that has been converted from a material of the Formula:

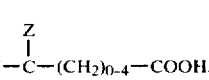

$$Y{-}\overset{\overset{\displaystyle Z}{|}}{C}{-}(CH_2)_{0\text{-}4}{-}COOH, \qquad (III)$$

wherein: Z is selected from the Group consisting of hydrogen, alkyl radicals that contain not more than about 4 carbon atoms and carboxyl units when Y is devoid of any carboxylating attachments; and Y is a monoethylenically-unsaturated substituent selected from the Group consisting of methylene, alkene and alkenyl units containing from 2 to about 5 carbon atoms and, when Z is not carboxyl, carboxylated methylene and monocarboxylated alkenyl units containing from 2 to about 5 carbon atoms; excepting that any said balance of the interpolymerized Formula (III) acid-containing monomer cannot exceed about 25 wt. % of the above-defined interpolymerized resinous material of which said carboxylated diene-monomer latex is comprised.

8. A method in accordance with any one of the methods of claims 1-6, inclusive, wherein the carboxylated diene-monomer latex applied in said Step (b) is an interpolymerizate in aqueous dispersion of at least about 1 wt. % of an interpolymerized resinous material that has been converted from a Formula (I) diene monomer that has been interpolymerized with between about 30 and about 98.5 wt. % of an alkenyl aromatic monomer of the Formula:

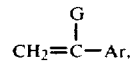

$$CH_2{=}\overset{\overset{\displaystyle G}{|}}{C}{-}Ar, \qquad (II)$$

wherein G is selected from the Group consisting of hydrogen and methyl and Ar is an aromatic radical, including various alkyl- and halo-ring-substituted units, of from 6 to about 10 carbon atoms; with an interpolymerized balance of not more than about 10 wt. % of converted and molecularly-combined Formula (III) acid-containing monomer.

9. A method in accordance with any one of the methods of claims 1-6, inclusive, wherein the carboxylated diene-monomer latex applied in said Step (b) is an interpolymerizate in aqueous dispersion of butadiene-1,3 (i.e., "Bu"), styrene (i.e., "St") and a Formula (III) monomer.

10. The method of claim 9 when said Formula (III) monomer is maleic acid (i.e., "MA").

11. An artificially-conditioned, treated nylon twine and the like or equivalent filamentary product, said twine product being characterizable as having extraordinary power and capability as compared with identically dimensioned raw nylon twine to be reliably tied into strong, durable and slip-resisting knot formations having features of secure dependability with at least substantially, if not completely, eliminated propensities to slitheringly loosen and become mechanically broken and de-interlacingly unfastened upon subjection to pulling-apart stress and/or strain force, said beneficiated twine comprising:

(i). a basic nylon twine body structure; upon and externally about which there is (ii). a circumenveloping thin-skin film layer of tightly-adhering superstrate deposit formation of carboxylated diene-monomer interpolymerizate synthetic resinous material.

12. A beneficiated treated nylon twine and the like product which is in accordance with that of claim 11, wherein:

said superstrate layer (ii) is the dried residue of a pre-applied latex preparation of the said carboxylated diene-monomer interpolymerizate.

13. A beneficiated treated nylon twine and the like product which is in accordance with that of claim 11, wherein the carboxylated diene-monomer synthetic resinous material in said superstrate layer (ii) is an interpolymerizate of:

at least about 0.5 wt. % of interpolymerized diene monomer of the Formula (I); and not more than about 25 wt. % of interpolymerized acid-containing monomer of the Formula (III).

14. A beneficiated treated nylon twine and the like product which is in accordance with that of claim 11, wherein the carboxylated diene-monomer synthetic resinous material in said superstrate layer (ii) is an interpolymerizate of:

at least about 1 wt. % of interpolymerized diene monomer of the Formula (I);

between about 30 and about 98.5 wt. % of interpolymerized alkenyl aromatic monomer of the Formula (II); with an interpolymerized balance of not more than about 10 wt. % of converted and molecularly-combined Formula (III) acid-containing monomer constituents.

15. A beneficiated treated nylon twine and the like product which is in accordance with that of claim 11, wherein the carboxylated diene-monomer synthetic resinous material in said superstrate layer (ii) is an interpolymerizate of:

between about 25 and about 60 wt. % of interpolymerized diene monomer of the Formula (I);

between about 40 and about 75 wt. % of interpolymerized alkenyl aromatic monomer of the Formula (II); with from about 1 to about 5 wt. % in the interpolymerizate of converted and molecularly-combined Formula (III) acid-containing monomer constituents.

16. A beneficiated treated nylon twine and the like product which is in accordance with either one of those of claim 14 or claim 15, wherein:

said Formula (I) diene monomer is Bu; and said Formula (II) alkenyl aromatic monomer is St.

17. A beneficiated treated nylon twine and the like product which is in accordance with either one of those of claim 14 or claim 15, wherein:

said Formula (I) diene monomer is Bu;

said Formula (II) alkenyl aromatic monomer is St; and said Formula (III) acid-containing, carboxylating monomer is MA.

18. A beneficiated treated nylon twine and the like product which is in accordance with that of claim 11, wherein the carboxylated diene-monomer synthetic resinous material in said superstrate layer (ii) is an interpolymerizate of: about 40 wt. % Bu; about 59 wt. % St; and about 1 wt. % MA.

19. A beneficiated treated nylon twine and the like product which is in accordance with any one of claims 11–15 or 18, inclusive, wherein:

said basic nylon twine body structure (i) is a cordlike wrapping twine that is particularly adapted by its size dimensionality for normal household and the like string-usage applications.

20. A beneficiated treated nylon twine and the like product which is in accordance with either one of those of claim 14 or claim 15, wherein:

said basic nylon twine body structure (i) is a cordlike wrapping twine that is particularly adapted by its size dimensionality for normal household and the like string-usage applications.

21. As an article of manufacture, a strong, slip-resistant and dependably secure knot formation that comprises and is tied into its interlaced structure with a beneficiated nylon twine and the like or equivalent filamentary product that is in accordance with any one of the twine products of claims 11–15 or 18, inclusive.

22. A granny knot according to claim 21.

23. As an article of manufacture, a strong, slip-resistant and dependably secure knot formation that comprises and is tied into its interlaced structure with a beneficiated nylon twine and the like or equivalent filamentary product that is in accordance with the twine product of claim 16.

24. A granny knot according to claim 23.

25. As an article of manufacture, a strong, slip-resistant and dependably secure knot formation that comprises and is tied into its interlaced structure with a beneficiated nylon twine and the like or equivalent filamentary product that is in accordance with the twine product of claim 17.

26. A granny knot according to claim 25.

27. As an article of manufacture, a strong, slip-resistant and dependably secure knot formation that comprises and is tied into its interlaced structure with a beneficiated nylon twine and the like or equivalent filamentary product that is in accordance with the twine product of claim 19.

28. A granny knot according to claim 27.

29. As an article of manufacture, a strong, slip-resistant and dependably secure knot formation that comprises and is tied into its interlaced structure with a beneficiated nylon twine and the like or equivalent filamentary product that is in accordance with the twine product of claim 20.

30. A granny knot according to claim 29.

* * * * *